United States Patent [19]

Woods

[11] Patent Number: 5,037,011

[45] Date of Patent: Aug. 6, 1991

[54] SPRAY-ON WALL SURFACE TEXTURE DISPENSER

[76] Inventor: John R. Woods, 5182 Topanga Canyon, Woodland Hills, Calif. 91634

[21] Appl. No.: 516,536

[22] Filed: Apr. 30, 1990

[51] Int. Cl.[5] ..... B65D 8/14

[52] U.S. Cl. ..... 222/394; 239/346

[58] Field of Search ..... 106/792, 795, 461; 156/71, 94; 401/190; 52/514; 239/346; 222/394, 402.15

[56] References Cited

U.S. PATENT DOCUMENTS

| | | | |
|---|---|---|---|
| 406,585 | 7/1889 | King | 106/795 |
| 2,016,986 | 10/1935 | Case | 106/792 |
| 3,317,140 | 5/1967 | Smith | 222/394 |
| 3,346,195 | 10/1967 | Groth | 222/394 |
| 3,687,890 | 8/1972 | Susuki, et al. | 106/461 |
| 4,123,005 | 10/1978 | Blunk | 239/346 |
| 4,364,521 | 12/1982 | Stankowitz | 239/346 |

FOREIGN PATENT DOCUMENTS

| | | | |
|---|---|---|---|
| 1536312 | 12/1978 | United Kingdom | 239/346 |

*Primary Examiner*—Michael S. Huppert
*Assistant Examiner*—Anthoula Pomrening
*Attorney, Agent, or Firm*—Roger A. Marrs

[57] ABSTRACT

A pressurized dispenser is disclosed herein having a container housing, a quantity of drywall texture material mixed with a binder, and a carrier such as aerosol. A manual pump or spray nozzle is included on the container for selective discharge of the drywall texture material onto a prepared patch which is a drywall sheet so as to match and blend in with the surrounding surface area to provide continuous and unbroken coextensive surface texture of mechanically and visually matched material.

2 Claims, 1 Drawing Sheet

SPRAY-ON WALL SURFACE TEXTURE DISPENSER

BACKGROUND OF THE INVENTION

1. Field of the Invention

The present invention relates to surface texture material dispensing devices and more particularly to a novel pressurized substance in semi-liquid form adapted to be sprayed onto a drywall surface so that after subsequent curing and hardening, a matching surface is provided with that of surrounding areas.

2. Brief Description of the Prior Art

It has been the conventional practice in the procedure of repairing drywall to remove the damaged portion of the wall and subsequently filling any holes, depressions or the like with a patch material. The patch material is applied by means of a trowel or other flat tool which will press the patch material into the hole or depression and which will prepare a surface area to receive a surface coating. After the patch material has cured and adhered to the original drywall material, a smooth surface is provided which receives the final coating. This coating leaves a smooth surface which is not matched to the surrounding drywall surface.

The drywall surface usually presents a surface texture which is bumpy or presents an orange peel look. Such an appearance and surface texture cannot be attained through the use of smoothing tools or patch tools once the patch material has been applied to the damaged or repaired area. Therefore, difficulties and problems have been encountered which stem from the fact that the use and application of conventional patching material on drywall repairs leaves a surface texture which does not match the surrounding area and which is noticeable after the complete repair has been completed.

Therefore, a long-standing need has existed to provide a novel material that may be readily applied to a repaired patch or surface so that the surface will match with the surrounding surface texture of the drywall. Furthermore, the surface texture material to be applied to a repaired or patched area should be contained in a handheld applicator so that the material may be conveniently stored as well as applied to the repaired area in a simple and convenient manner.

SUMMARY OF THE INVENTION

Accordingly, the above problems and difficulties are obviated by the present invention which provides a novel dispenser including a pressurized container holding a quantity of surface texture material in a fluid or semifluid condition so that upon depression of a dispensing nozzle, the material will be emitted and directed to the patch area intended to receive the surface texture. The surface texture material includes a binder and an aerosol serving as a carrier medium so that the texture material will adhere to the repaired patch and drywall surface.

In one form of the invention, the drywall textured material may be of a polyvinyl base or emulsion having a limestone liquid form. The adhesive binder may be an acrylic and the carrier for pressurizing the dispensing of the material may be an aerosol.

Therefore, it is among the primary objects of the present invention to provide an inexpensive and economical means for matching surface texture of a repaired or patched surface area on a drywall panel with the surrounding surface area of the drywall.

Another object of the present invention is to improve the appearance of patched or repaired areas on a drywall surface by employing a spray-on textured material which covers the repaired or patched area and visually assumes the surface texture of the surrounding drywall surface.

Still another object of the present invention is to provide a hand-held dispensing unit containing a pressurized drywall surface textured material for spray-on and direct application of the material in a liquid or semi-liquid form onto a repaired or patched area so that the surrounding drywall surface texture will be visually and mechanically matched.

Yet a further object of the present invention is to provide a pressurized textured material in a dispenser that may be sprayed onto a patched area in drywall so as to match the surface texture normally applied with a compressor onto the drywall surface.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
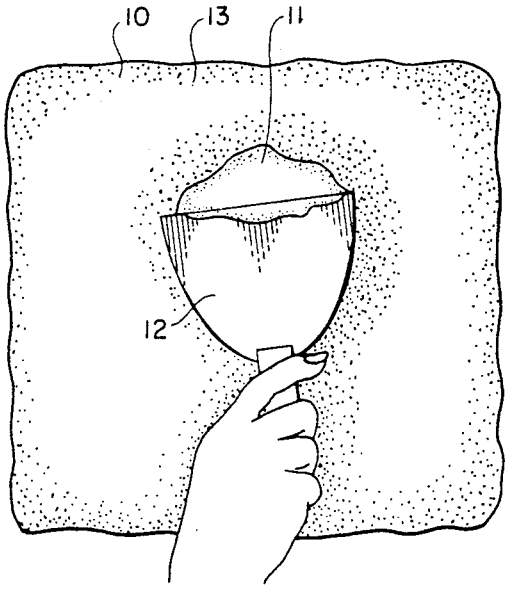
FIG. 1 is a diagrammatic view showing a typical and conventional repair of a drywall panel having a hole therein receiving patch material.

Referring now in detail to FIG. 1, a fragmentary view is shown of typical wallboard and is identified by numeral 10. The wallboard panel has been damaged and a repair to the damaged area is illustrated by numeral 11 which takes the form of a plaster patch that is placed in position by means of a trowel or other hand tool 12. After curing, the patch becomes solidified and adheres to the edge marginal region of the wallboard defining the hole covered by the patch material. The surface texture of the wallboard is identified by numeral 13 and it can be seen that the surface texture is broadly defined as being bumpy, pebbled or presenting an orange peel look.

Figure 2:
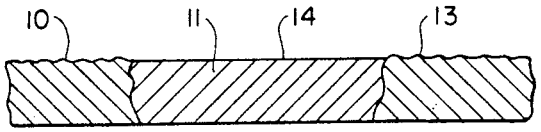
FIG. 2 is a transverse cross-sectional view of the repaired or patched area shown in FIG. 1 illustrating the dissimilarity in surface texture between the original drywall surface and the surface of the patched area.

In FIG. 2, it can be seen that the patch 11 displays a smooth surface 14 usually attained by repeatedly drawing the edge of a hand tool 12 across the surface. After drying or curing, the material of the patch becomes hard and the surface 14 remains smooth and unmatched with the surrounding irregular or raised surface 13 carried on the drywall panel 10. Although the surface 14 will accept a variety of coating such as paint or the like, the surface texture of the coating does not simulate or blend with the surrounding irregular surface 13. Visually, the flat patch area is always noticeable and indicates the presence of a repair.

Figure 3:
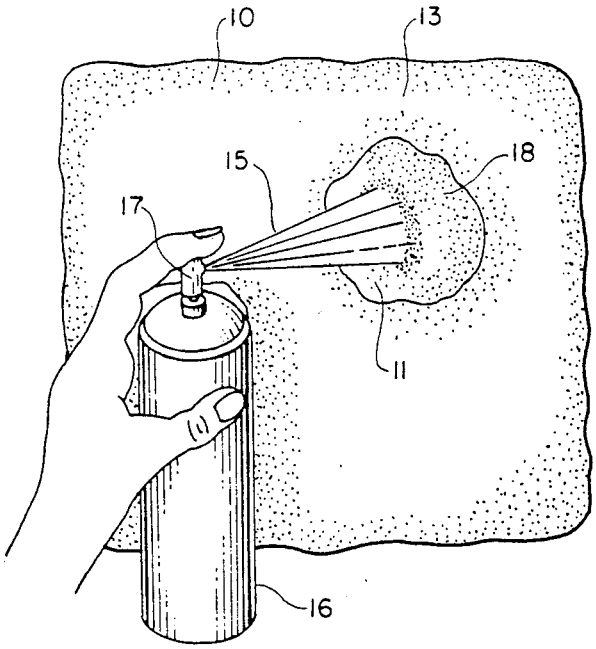
FIG. 3 is a view similar to the view of FIG. 1 illustrating the direct application of the spray-on surface texture material of the present invention.

Referring now in detail to FIG. 3, the novel material and dispenser of the present invention is illustrated as being applied to the smooth surface 14 of the patch 11. In this connection, a bumpy and irregular surface is placed on the flat surface 14 so as to be compatible with, blend with and be coextensive with the surrounding drywall surface area. By employment of the present invention, the surface texture of both the patch and the surrounding drywall are substantially identical and matched so that no visual indication is presented or noticeable pertaining to a repair or patch. The material being applied is broadly indicated by numeral 15 which is contained within a container 16 and applied in the form of a spray in either liquid or semi-liquid condition. Application is achieved by depression of a pump or spray nozzle 17 which permits discharge of the pressurized material carried within the container 16. Such an application of the material is directly placed on the desired area 14 by the user who hand-carries the container 16 and operates the nozzle 17 on site. Wastage and loss of material is avoided since the discharge is under the control of the user through the application of the discharge nozzle 17. Therefore, there is no residue or excess material that is not used which requires disposal. Furthermore, the material 15 is lumpy and after curing on surface 14, provides an irregular surface 18 compatible and matching the surrounding drywall surface area. Furthermore, the material in the container is considered a finished product and does not require additives of any kind, and the labelling on the container may provide identification numbers and laboratory information.

Preferably, the material 15 comprises a mixture of an emulsion base material such as polyvinyl which includes limestone in liquid form and which contains a binder as an adhesive that may take the form of an acrylic. For pressurized discharge, an aerosol may be employed as a carrier with the emulsion, binder and limestone liquid.

Figure 4:
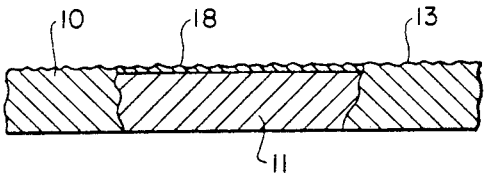
FIG. 4 is a transverse cross-sectional view of the repaired or patched area on a drywall panel and illustrating matching of surface texture between the surface of the patch and the surrounding drywall surface after use of the novel spray-on surface texture material of the present invention.

FIG. 4 illustrates the coating 18 which is applied directly to the smooth surface 14 and when dried or cured results in an irregular surface having a texture compatible and matched with the surrounding surface texture of the drywall as indicated by numeral 13. The patch material 11 is dried and cured in preparation for receiving the coating 18 and the binder included in the material 15 insures adhesion of the material to the patch area. Even if small amounts of the material would extend beyond the surface 14 onto the drywall, the surface would still be matched and no unsightly patch edges or dissimilar surface texture would be detectable.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Dispensing means for applying a hardenable flowable liquid to the surface of a patch surrounded by a drywall surface of irregular surface texture comprising the combination of:

a fluidtight container having a quantity of hardenable fluid intended to be dispensed;

means carried on said container selectively in communication for releasing said hardenable fluid in the form of a spray;

said hardenable fluid comprising a mixture of a base emulsion, a limestone liquid, an adhesive binder and a pressurized carrier of compressed gaseous characteristics;

said hardenable fluid further characterized as having a bumpy, irregular surface texture after curing that is matched with and compatible with the surrounding drywall patch; and said base emulsion is a polyvinyl composition and said binder is an acrylic while said carrier is an aerosol.

2. The invention as defined in claim 1 wherein:

said container is hand-held and said releasing means is a finger-operated discharge nozzle.

* * * * *